US009523526B2

(12) United States Patent
Brunner et al.

(10) Patent No.: US 9,523,526 B2
(45) Date of Patent: Dec. 20, 2016

(54) ICE MAKING APPARATUS AND PROCESS OF REDUCING SCALE BUILDUP AND FLUSHING THE APPARATUS

(71) Applicants: Roger P. Brunner, Wind Gap, PA (US); Thomas H. Scarince, Washington, NJ (US)

(72) Inventors: Roger P. Brunner, Wind Gap, PA (US); Thomas H. Scarince, Washington, NJ (US)

(73) Assignee: Follett Corporation, Easton, PA (US)

( * ) Notice: Subject to any disclaimer, the term of this patent is extended or adjusted under 35 U.S.C. 154(b) by 152 days.

(21) Appl. No.: 14/322,128

(22) Filed: Jul. 2, 2014

(65) Prior Publication Data

US 2016/0003515 A1 Jan. 7, 2016

(51) Int. Cl.
*F25C 1/14* (2006.01)
*F25C 1/22* (2006.01)

(52) U.S. Cl.
CPC ..... *F25C 1/147* (2013.01); *F25C 1/14* (2013.01); *F25C 1/145* (2013.01); *F25C 1/225* (2013.01)

(58) Field of Classification Search
CPC ..... F25C 1/147; F25C 1/14; F25C 1/145; F25C 1/225
USPC ..... 62/354
See application file for complete search history.

(56) References Cited

U.S. PATENT DOCUMENTS

| | | | | |
|---|---|---|---|---|
| 2,280,320 | A * | 4/1942 | Taylor | 62/347 |
| 3,310,958 | A * | 3/1967 | Stiller | 62/348 |
| 3,910,060 | A * | 10/1975 | Beusch | 62/188 |
| 6,857,284 | B1 | 2/2005 | Brooks | |
| 7,322,201 | B2 | 1/2008 | Brunner | |
| 2007/0006606 | A1* | 1/2007 | Kaga et al. | 62/354 |
| 2011/0041542 | A1* | 2/2011 | Brunner et al. | 62/344 |

* cited by examiner

*Primary Examiner* — Marc Norman
*Assistant Examiner* — David Teitelbaum
(74) *Attorney, Agent, or Firm* — Paul & Paul

(57) ABSTRACT

An ice making apparatus is provided for making ice of the nugget-forming type from ice shavings that are compacted, wherein inlet water is provided to a freezing chamber having a rotatable auger therein, for flow of the inlet water and water squeezed from ice leaving the freezing chamber at the discharge end thereof along the auger, for flow of water through the freezing chamber, to a water reservoir at an opposite end of the freezing chamber, whereby ice flow through the freezing chamber is in one direction, and water flow through the freezing chamber is in an opposite direction. Dissolved minerals are thereby substantially removed from the ice being discharged from the freezing chamber, and are conveyed from a zone of lesser water volume to a zone of higher water volume where they are more substantially dispersed. Water is flushed from the freezing chamber, by dispensing water containing dissolved minerals from a reservoir of greater volume than the volume of water at the water inlet end of the freezing chamber.

19 Claims, 3 Drawing Sheets

ICE MAKING APPARATUS AND PROCESS OF REDUCING SCALE BUILDUP AND FLUSHING THE APPARATUS

BACKGROUND OF THE INVENTION

As water goes through the freezing process, dissolved minerals in the "sump" or "make-up" water tend to increase in concentration. That is, in a given volume of water, the pure $H_2O$ will be the first to solidify; minerals that had been in the volume of the solidified water remain in solution and thereby cause the balance of liquid water to increase in mineral concentration. Dissolved minerals are usually referenced as "total dissolved solids" (TDS), and can be readily measured in units of parts per million (PPM).

In a commercial ice making machine (nugget or cube), relatively pure ice is formed and evacuated from the machine. As the ice leaves the machine, the concentration of the total dissolved solids (TDS) increases in the water within the evaporator or sump. (Note: the "sump" of a nugget ice machine is typically the evaporator barrel itself). The TDS level in the sump can increase greatly relative to the TDS level of the in-coming fresh water. This said, the sump TDS concentration is greatly dependent on the volume of available sump water; small water volumes can rapidly increase to maximum TDS levels in an ice machine. A short period of running (say, 10 minutes for example) could yield maximum sump TDS levels if the sump capacity is limited.

Conventional ice makers will periodically shut off the ice making process and drain the sump to evacuate the elevated TDS. Fresh water is then introduced to the system and the ice making process re-started. Cube-type ice makers will flush-out the system as often as every batch (perhaps every 20 minutes) while nugget ice machines may allow up to an hour of operation before dumping the high TDS water. Some commercial systems continuously measure the TDS and will interrupt operation for a flush cycle based on TDS limits.

Scale growth rates are somewhat related to TDS levels, although the prediction of scale formation typically combines additional factors including water pH, hardness, temperature, TDS composition, etc. TDS levels can be used to depict the magnitude of change of the water chemistry within the sump. Focus is placed on the differences between the fresh water and the sump water using TDS as an easy-to-measure metric. It is implied that if TDS increases as a multiple of the fresh water, some detrimental effects of the water chemistry could increase as well. Fresh water of a given chemistry is as "stable" as possible, and that any increase in TDS concentration could serve to "de-stabilize" or saturate the water toward detrimental effects, like scale growth.

To establish a perspective of common levels of TDS found in potable water supplies, some benchmarks are cited: fresh water of, say, 100 PPM (parts per million) can be referred as "good" water that does not need treatment, but water of, say, 600 ppm could form scale and often requires scale inhibiting treatments. TDS in commercial bottled water is found to be about 100 ppm. Some municipal water supplies attempt to limit fresh water TDS to 400 ppm, but will often treat water known to be scale prone. There are bands of geographic areas in the USA where water supplies can be measured to 600 ppm, with a few sporadic sites of very high TDS ranging between 800 to 1500 ppm, but these are rare findings that are usually related to seasonal or other extraneous circumstances. It is common to find water treatment systems in these areas of elevated TDS, because the added expense of treatment is offset by the extended operation of the ice makers.

In addition to TDS measurements, a common reference for predicting scale formation is the Langlier index. The derivation of the Langlier measurement is more complex than a simple TDS measurement because it combines additional factors that need to be measured (pH, hardness, temperature, etc.). This said, water samples can be taken and a Langlier measurement can be derived. Langlier uses the mineral saturation level of the water as a predictor of scale growth. A level of "0" is considered neutral in scale formation; −1 has almost no chance of forming scale while +1 has a great propensity to form scale. The Langlier index of some water samples is cited below, again to show the magnitude of chemistry change of the water within an ice machine. The intent is to further highlight the magnitude of change of the sump water from fresh water.

However, within an ice maker, it is commonly observed that scale forms in just about all applications to lesser and greater extents based on water chemistry. Scale has been shown to aggressively form in an ice maker with water supplies of 200 ppm. The reason is as follows.

In an ice machine, as described above, water in the freezing chamber quickly reaches elevated mineral concentrations as a by-product of the freezing process. During operation, the concentration of TDS in the freezing chamber can easily be measured in the 1000's ppm range even though the fresh supply is so-called "good" water. Concentrations in the >6000 ppm range are measured in the freezing chamber of machines operating in high TDS fresh water supplies. Scale tends to rapidly form in the regions of the ice maker that tend to hold high concentrations of minerals, and conventional water treatments can tend to be only marginally effective at keeping scale from firming within the ice maker. Treatment systems that target the fresh water were not necessarily designed to manage the chemistry of the sump water.

An experiment shows the chemistry changes of the sump water in a scale prone application: Water samples were extracted and analyzed from an ice maker application site.

| | TDS | Langlier Index |
|---|---|---|
| Fresh Water | 469 ppm | −0.2 |
| Evaporator Water drained out shortly after turning the machine off | 2226 ppm | +1.3 |
| Water from Melted Ice | 716 ppm | +0.2 |

It is clear that the water chemistry of the sump has completely changed into that which has greatly increased in TDS and has a strong potential to form scale; the Langlier index is very high.

A very critical aspect of TDS within a nugget ice machine is the fact that the concentration of TDS is not uniform in the freezing chamber. During operation of a nugget ice machine, high TDS water tends to be concentrated in the area of ice compression (at the discharge end of the auger) because of the confluence of several factors.

The actual squeezing of the ice occurs in this area; the purer ice leaves the machine from this area while the squeezed-out water remains behind.

Also, the local sump water in this area, with a given TDS level of "x" is forced to accept the squeezed-out water with the same TDS level, "x". But because the volume of water in this area remains constant as ice is evacuated, the "local"

sump TDS climbs to 2×, 3×, 4× etc. until a balance is struck between the fresh water TDS and the amount of TDS leaving the machine with the nugget.

Additionally, the available water volume is quite small in this area (this "local" sump area) owing to the fact that most of the auger open volume is filled with ice. The minute volume of water that is available to accept the squeezed-out high TDS water therefore tends to locally increase in TDS very rapidly to very high levels; levels that will readily form scale.

Furthermore, fresh water is conventionally fed in the end of the freezing chamber that is opposite the ice discharge end. Fresh water dilutes the TDS in the area in which it is fed but never can effectively reach the ice discharge end. Thus, experience has shown a high TDS concentration zone of a nugget ice maker to be in the region of the discharge end of the auger in prior art devices.

Fresh water in prior art applications enters from the rear of the machine at the reservoir and generally flows forward toward the ice discharge end. The high TDS water in the discharge end of the machine never has a chance to dilute. Only the conventional flushing process removes it from the machine. The flushing process unfortunately causes unwanted down-time, and water waste. Most often, a machine is caused to operate for a period with maximum TDS levels in the scale zone at the discharge end of the auger until flushing occurs.

Scale growth, particularly on the auger surface, in the discharge area of the machine, tends to "grab" the ice flakes. Rather than allowing the ice to freely move along the polished steel auger surface, the ice drags on the scaled surface. This leads to ice compaction on the auger and can soon render the ice maker inoperable because the ice can no longer reach the evacuation port of the machine. The only remedy is to clean the scale off of the auger with caustic cleaners or to disassemble and mechanically remove the scale from the auger. Often the owner is forced to install water treatment means to try to extend the intervals between needed cleaning, hut these can be somewhat futile since they are designed to manage the elements of the fresh water, not the excessive TDS levels found in the scale zone.

Because fresh water enters the rear area of the auger at the reservoir, TDS levels are much lower than the front (discharge end) area, and scale growth is minimal.

It is important to note that this elevated TDS phenomenon (the scale zone) occurs in all types of commercial nugget machines. The orientation of the freezing chamber is not the governing issue; the elevated TDS at the discharge end of the auger (horizontally or vertically disposed), coupled with the fresh water feed from the opposite end, renders the important auger working surface covered in scale.

Scale growth is related to the nugget hardness; harder nuggets tending to be more pure leave higher TDS behind in the scale zone. Harder nuggets tend to evacuate less water. The ice in the scale zone will be compacted more in order to drive the harder nuggets through the compression nozzles, and will be more susceptible to drag on the scale. Harder nuggets, however, are the preferred form because of the improved mechanical properties; they dispense better and they don't tend to clump up in the ice storage bin.

Nuggets that contain water with elevated TDS tend to degrade faster than those compacted within low TDS water. In a conventional machine, since ice is being compressed in the scale zone, the water carried out by the nugget is at the highest TDS level of all the water in the evaporator. TDS in the water can lower the freezing point, and therefore the nugget degrades. The best nugget characteristics are achieved when the "local" water (the water in the area of the ice during ice compression) is of the lowest possible TDS; i.e. fresh water.

SUMMARY OF THE INVENTION

The present invention is directed to an improved ice making apparatus wherein inlet water is supplied to the freezing chamber via the discharge end of the auger for flow of inlet water and of water squeezed from ice at the discharge end of the auger in the freezing chamber, along the auger, from the discharge end of the auger to the water reservoir at an opposite end of the auger and freezing chamber. The present invention is also directed to a process of reducing scale buildup from dissolved minerals in water at the discharge end of the auger and freezing chamber by providing the water inlet to the discharge end of the freezing chamber for flow along the auger and for flow of water squeezed from ice at the discharge end of the auger, both in an opposite direction to the direction of conveyance of ice along the rotatable auger, to a water reservoir of relatively large volume as compared to the small volume of water at the discharge end of the auger, whereby dissolved minerals in the water are conveyed from the zone of relatively small volume to the water reservoir of relatively large volume.

The present invention is also directed to a process of flushing water containing dissolved minerals from an ice making apparatus during the continuous production of ice by supplying inlet water to the freezing chamber while dispensing water containing dissolved minerals from the reservoir, wherein the supplying and dispensing of water are either continuous, or pulsed so as to be substantially continuous.

Accordingly, it is an object of this invention to provide an ice making apparatus for making ice of the nugget-forming type from ice shavings that are compacted, in which a refrigeration system provides a refrigerant to a freezing chamber of the hollow cylinder type, in which water is frozen on a cylindrical inner wall of the freezing chamber, and wherein a rotatable auger scrapes ice from the wall of the chamber and conveys it along a rotatable auger to an ice discharge end of the auger in which water is squeezed from ice and wherein the ice is then conveyed to an ice compression means, and wherein a water reservoir is located at an end of the auger opposite the ice discharge end of the auger, and wherein means are provided for supplying inlet water to the freezing chamber via the discharge end of the auger for flow from the discharge end of the auger to a water reservoir at the opposite end of the auger from the discharge end.

It is a further object of this invention to accomplish the above object, while reducing scale buildup from dissolved minerals in the water at the discharge end of the auger by providing inlet water to the discharge end of the freezing chamber for flow along the auger from the discharge end of the auger and for flow of water squeezed from ice at the discharge end of the auger, both along the auger in an opposite direction to the direction of conveyance of ice along the rotatable auger, to a water reservoir of relatively large volume relative to the relatively small volume of water at the discharge end of the auger, wherein dissolve minerals are conveyed along the auger in an opposite direction to the flow of ice along the auger, to a water reservoir of relatively large volume at the opposite end of the auger from the ice discharge end of the auger.

It is yet another object of this invention to provide a process for flushing water containing dissolved minerals from an ice making apparatus during the continuous production of ice by supplying inlet water to the freezing chamber while draining water containing dissolved minerals from a reservoir at an opposite end of the freezing chamber and auger from the ice discharge end of the auger, wherein the supplying and draining steps are either continuous, or pulsed, to be substantially continuous.

Other objects and advantages of the present invention will be readily apparent upon a reading of the following Brief Descriptions of the Drawing Figures, the Detailed Descriptions of the Preferred Embodiments and the appended claims.

BRIEF DESCRIPTIONS OF THE DRAWINGS

FIG. 1 is a schematic diagram of a refrigeration cycle for making ice within the evaporator portion of the refrigeration cycle, wherein ice is formed along an interior wall of a freezing chamber, with an auger in the freezing chamber, for conveyance of ice along the auger for discharge at the left end of the auger of FIG. 1, and wherein inlet water is provided to the freezing chamber, entering the same at the left end of the freezing chamber/auger, with the water flowing rightward as viewed in FIG. 1, to a reservoir at the right end of the apparatus of FIG. 1.

DETAILED DESCRIPTIONS OF THE PREFERRED EMBODIMENTS

Figure 1:
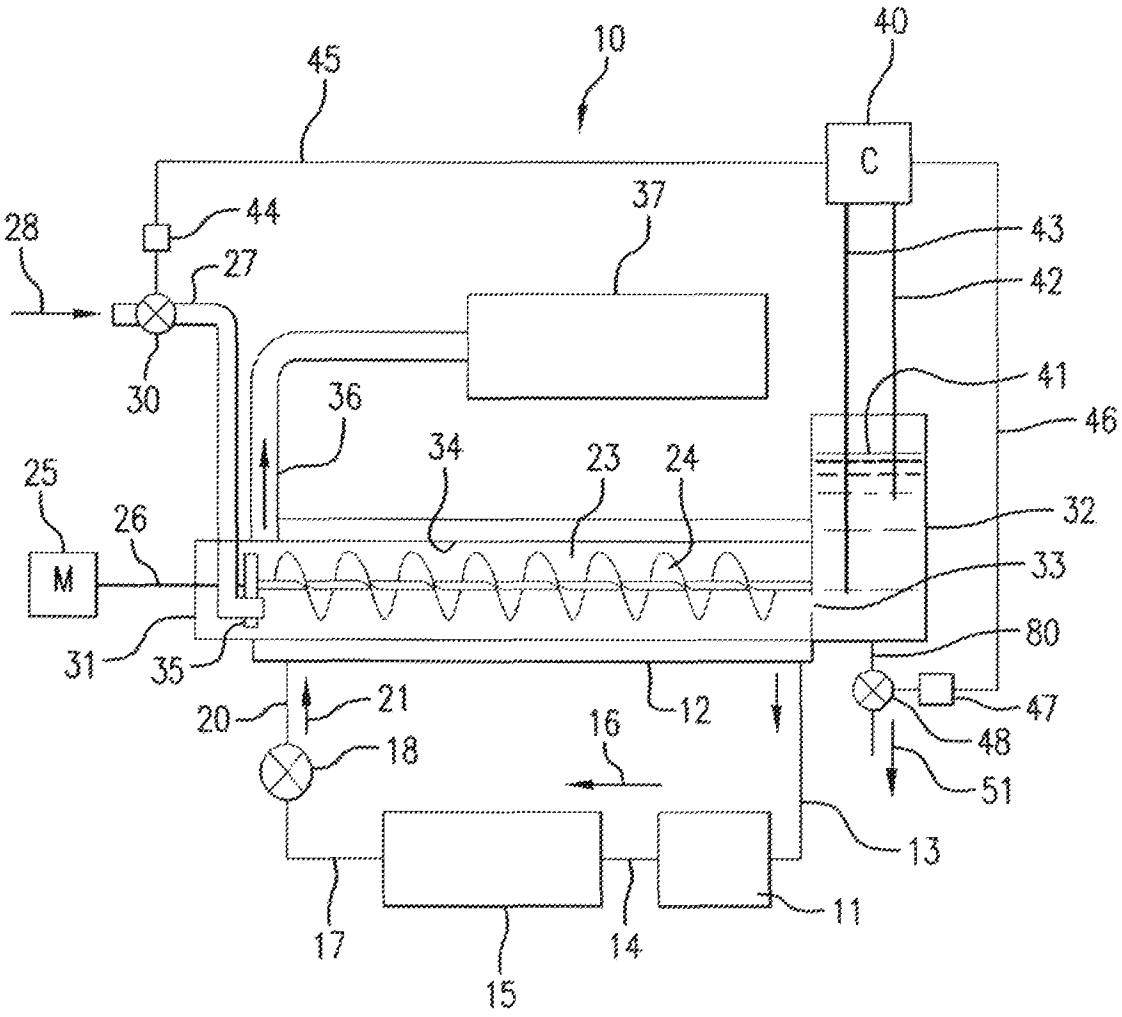

Referring now the drawings in detail, reference is first made to FIG. 1 wherein the refrigeration cycle 10 is schematically illustrated. The refrigeration cycle includes a compressor 11 which receives a refrigerant fluid from the evaporator 12 via refrigerant fluid line 13, and compresses the refrigerant fluid for delivery via line 14 to a condenser 15, in the direction of the arrow 16, for subsequent delivery via refrigerant line 17 through an expansion valve 18, for return to the evaporator 12 at the left end thereof via refrigerant line 20, in the direction of the arrow 21.

In this regard, the refrigeration cycle is conventional.

Within the evaporator 12 there is a freezing chamber 23 that is preferably horizontally disposed, as illustrated in FIG. 1, with a generally helically configured auger 24 disposed therein, for rotation, driven by the motor 25 via a shaft 26.

Inlet water is provided into an inlet water supply line 27 from any suitable water supply, in the direction of the arrow 28, for supplying the inlet water through a valve 30. The inlet water is thus supplied via water supply line 27, inside the left end 31 of the freezing chamber 23, with water then passing rightward through the freezing chamber 23 into a reservoir 32 at the right end of the freezing chamber 23, via an inlet 33.

The cold refrigerant in the evaporator 12 causes water to freeze along the interior of the cylindrical wall 34, generally in the form of ice flakes.

The rotating auger 24 scrapes the ice from the interior wall 34 of the freezing chamber, and delivers the ice flakes from right to left as oriented in FIG. 1, toward the left end 31 of the freezing chamber 23. Specifically, the ice is delivered toward an auger flange 35 at the left end of the freezing chamber 23, and the ice is compressed at the left end of the auger and freezing chamber for discharge from the freezing chamber, through an ice compression means as will be addressed with respect to FIG. 2 hereof by means of a paddle that pushes the ice upward through a compression means, into an ice transport tube 36, for delivery to an ice retaining vessel 37.

A computer or other controller 40 monitors the level 41 of water in the reservoir 32 via high and low water level control rods 42, 43 which provide water level information to the computer or other controller 40 for controlling a solenoid or other switch 44 that controls the opening and closing of the valve 30 for water inlet into line 27 via control line 45. The computer or other controller 40 similarly controls, via control line 46, the solenoid or other controller 47 for controlling the opening and closing of valve 48 via water discharge line 50 from the reservoir 32. The control of water to and from the freezing chamber and reservoir 32 as discussed above can be in accordance with the disclosure of U.S. Pat. No. 7,469,548, the complete disclosure of which is herein incorporated by reference. The discharge of water through valve 48 and line 50 is therefore in the direction of the arrow 51 of FIG. 1.

Figure 2:
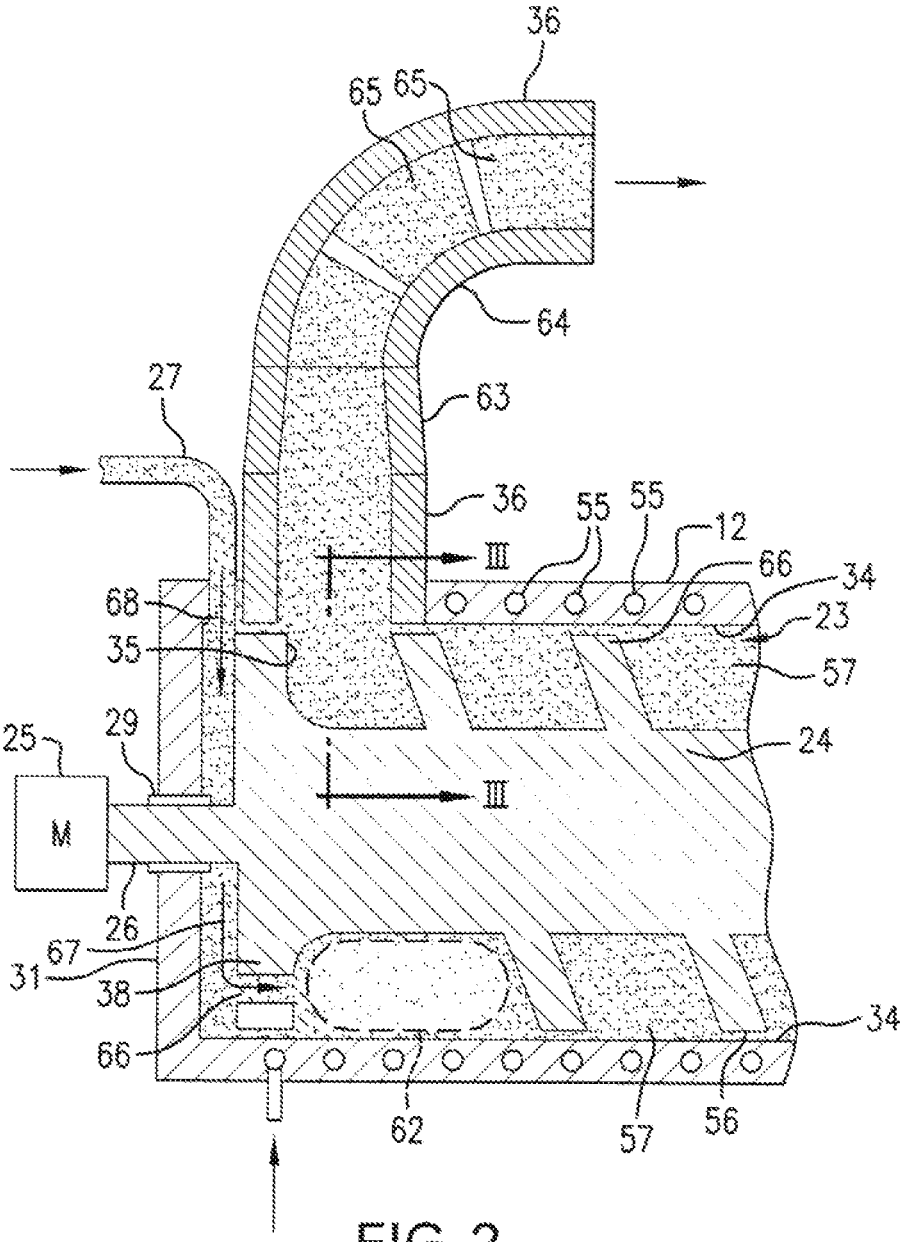
FIG. 2 is an enlarged fragmentary illustration of the left end of the freezing chamber/auger, illustrating the inlet water feed at the left end of the freezing chamber, and ice being scraped from the inner wall of the freezing chamber by the auger, and being compacted for upward delivery through a compression zone, and to a conduit, whereby compacted ice breaks up into nuggets for discharge.
Figure 3:
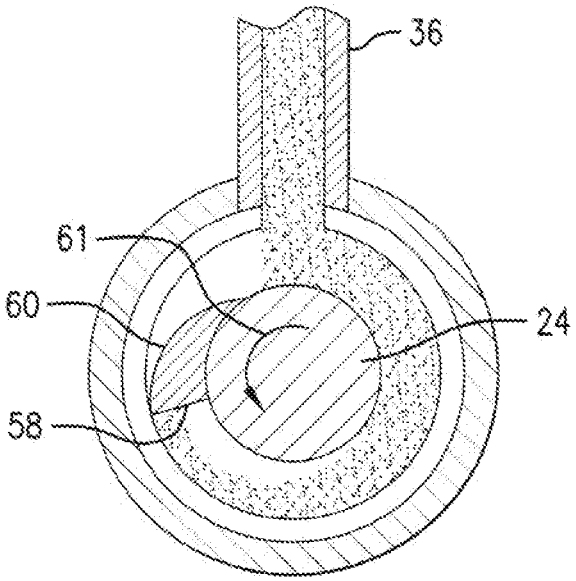
FIG. 3 is a transverse sectional view of a portion of the left end of the freezing chamber/auger of FIG. 2, taken generally along the line of III-III of FIG. 2.

Referring now to the illustrations of FIG. 2 and FIG. 3, it will be seen that the evaporator 12 is provided with suitable refrigerant flow lines 55, which enable the freezing of water on the interior cylindrical wall 34 of the freezing chamber 23. The motor 25 is shown to drive the shaft 26 which passes through the left end 31 of the freezing chamber via a suitable bearing/seal 29, whereby the auger 24 is rotatable, such that its generally helically configured periphery 56 scrapes ice 57 from the cylindrical wall 34, and drives it leftward, becoming increasingly compressed as it approaches the flange 35 at the left end of the auger 24 whereby the increasing compressed ice is pushed upwardly by the surface 58 of the paddle 60 carried by the rotating shaft 24, rotating in the direction of the arrow 61 illustrated in FIG. 3, so that the increasingly compressed ice is squeezed, squeezing water therefrom, which water will contain mineral deposits, which will leave water containing a higher level of mineral deposits into a relatively small volume zone 62 at the left end of the auger 24. This zone 62 is illustrated by the broken line oval at the left end of the freezing chamber 23 in FIG. 2. Because of the squeezing of water from the ice as it is discharged from the left end of the freezing chamber 23 as shown in FIG. 2, the ice entering the conduit 36 is relatively free of liquid water and associated TDS.

The ice entering the conduit 36 is pushed upward through a reducing cross-section compression zone 63 during which it is highly compressed prior to being delivered around an arcuate portion 64 of the ice delivery conduit 36, where it is broken up into discreet nuggets 65, for delivery to the ice retaining vessel 37.

It will thus be seen that the direction of flow of ice through the freezing chamber 34 is from right to left in FIGS. 1 and 2, whereas the direction of flow of water fed from the water inlet line 27, is from left to right, from the zone of lesser volume 62, to a reservoir zone 32 of greater volume, whereby mineral deposits (TDS) enter the reservoir zone 32 of greater relative volume via the inlet 33 thereto.

The feed of inlet water via line 27, is into the left end of the freezing chamber, through an opening 66 in the flange 35, in the direction of the arrows 67, 68, into the lesser volume zone 62, and is prior to the ice compression zone.

Because scale tends to form where water is being squeezed from the ice, at the left end of the auger/freezing zone, such scale tends to form on surfaces of the auger 24 at the left end thereof. In accordance with this invention, a computer 40 will activate the solenoid 44 or other control, that controls the valve 30, for continuous or pulsed feed of fresh water, for diluting TDS water as a result of the squeezed ice flakes entering the conduit 36, for flow of such water containing higher TDS levels, from the zone 62 of lesser volume, to flow rightwardly along the auger, to enter the reservoir 32 of greater volume, whereby the greater volume of water in the reservoir 32 will further dilute the TDS level in that water. The computer or other controller 40 will control the discharge of water via controlling the solenoid 47 that controls the discharge valve 48 from the reservoir 32. Such discharge water from the reservoir 32 can either be continuous, or periodic. A minimum amount of flushing, necessary to control scaling, is preferred.

Thus the system can be flushed on a continuous or substantially continuous (pulsed) basis. When the flushing occurs on a pulsed basis, it occurs at a predetermined on/off periodicity.

It will be noted that in the apparatus discussed above with respect to FIGS. 1 and 2, the flange 35 separates the inflow of water via line 67, through the opening 66 in the flange 35, so that such in flow of water is separated from the area of compression, wherein water is squeezed from the ice, in conduit 36 and compression zone 63.

It will also be noted that, in accordance with this invention, the direction of flow of ice from the right end is toward the left end of the auger, whereas the direction of flow of inlet water is from the left end of the freezing zone/auger, along the auger (rightward in FIGS. 1 and 2) into the reservoir 32. In the flow of water through the freezing zone 23, the water generally flows spirally along the auger toward the reservoir 32, transporting dissolved minerals toward the end of the system having the greater volume; namely the reservoir 32.

In flushing the system, it is preferred to employ dynamic flushing; i.e., to open the reservoir discharge valve 48 while the ice making apparatus is in operation making ice. Preferably, the pressurized inlet water feed will out-pace the flow of water draining from the reservoir such that proper operating water levels can be maintained, and ice production is able to continue. During such dynamic flushing, minimal water is wasted because only a small volume of water is needed to carry the minerals. Short, frequent dynamic flushes are preferred. For example, 15 second flush cycles on 15 minute intervals has been found to be very satisfactory.

While the present invention has been addressed with respect to horizontally disposed freezing chambers/augers, other oriented systems, such as a vertically disposed freezing chamber/auger systems lend themselves to improvement by the inventive features set firth above.

It will be appreciated that the dynamic flushing system described herein minimizes or eliminates scale growth on the working surfaces of the ice making apparatus; it minimizes or eliminates the need for frequent or expensive/intensive cleaning of the system; it minimizes or eliminates the need for pre-treatment of water, via softeners, scale inhibiting additives, reverse osmosis filtering, etc.; it eliminates unwanted down-time of the ice making apparatus during a water flushing process; it minimizes the amount of water needed to flush out the apparatus; and it improves the mechanical properties of the ice nugget as well as improving nugget dispensability and reducing the degradation of the nugget over time.

It will be apparent from the foregoing that various modifications may be made in the details of construction of the apparatus described herein, and of the processes described herein and that various modifications may be made in the details of construction as well as in the use and operation of the apparatus in accordance with this invention, all within the spirit and scope of the invention as defined in the appended claims.

What is claimed is:

1. An ice making apparatus for making ice of a nugget-forming type from ice shavings that are compacted, comprising:

a refrigeration system for providing refrigerant to a freezing chamber of a hollow cylinder type;

the freezing chamber being a hollow cylindrical inner wall for receiving water on said hollow cylindrical inner wall for forming ice on the hollow cylindrical inner wall;

a rotatable ice auger sized to fit inside said freezing chamber and comprising means for scraping the ice formed on the hollow cylindrical inner wall of said freezing chamber and conveying the ice from the hollow cylindrical inner wall of said chamber, along said rotatable auger, to an ice discharge end of the auger in the freezing chamber and squeezing the water from the ice shavings at the discharge end of the auger, and after squeezing the water from the ice shavings conveying the ice shavings to an ice compression means;

means to cause rotation of said rotatable ice auger;

means for supplying inlet water to said freezing chamber;

the ice compression means outside the freezing chamber for receiving ice shavings from said freezing chamber and compressing the ice shavings into compacted solid form ice while squeezing water from the ice shavings;

a water reservoir located at an end of the rotatable ice auger opposite the ice discharge end of the rotatable ice auger; and wherein the means for supplying inlet water to the freezing chamber is at the ice discharge end of the rotatable auger, so as to generate a first flow of water from the means for supplying inlet water, the first flow of water and the water squeezed from the ice compression means are combined at the ice discharge end of the auger and travel from the ice discharge end of the rotatable ice auger to the water reservoir.

2. The ice making apparatus of claim 1, wherein the means for supplying water to the freezing chamber is through an auger flange at the ice discharge end of the rotatable ice auger.

3. The ice making apparatus of claim 1, wherein the means for supplying inlet water is a means supplying a continuous flow of inlet water.

4. The ice making apparatus of claim 1, wherein the means for supplying inlet water is a means supplying a pulsed flow of inlet water.

5. The ice making apparatus of claim 1, wherein the means for supplying inlet water to the freezing chamber is at a location between the ice discharge end of the rotatable ice auger and the ice compression means.

6. The ice making apparatus of claim 1, including an ice transport tube for receiving the compacted solid form ice from said ice compression means.

7. The ice making apparatus of claim 1, wherein the freezing chamber and rotatable ice auger are horizontally disposed.

8. A process of reducing scale buildup from dissolved minerals in water at a discharge end of a rotatable ice auger comprising an ice making apparatus for making ice of a nugget-forming type from ice shavings that are compacted, wherein the ice making apparatus comprises:

a refrigeration system for providing refrigerant to a freezing chamber of a hollow cylinder type;

the freezing chamber having a hollow cylindrical inner wall for receiving water within the freezing chamber for forming ice on said hollow cylindrical inner wall;

the rotatable ice auger sized to fit inside said freezing chamber and comprising means for scraping ice formed on the hollow cylindrical inner wall of said freezing chamber, to form the ice shavings, and conveying the ice shavings from the hollow cylindrical inner wall of said freezing chamber, along said rotatable ice auger to an ice discharge end of the rotatable ice auger in the freezing chamber where the water is squeezed from the ice shavings in a first zone of a first volume for delivery to an ice compression means;

means to cause rotation of said rotatable ice auger;

means for supplying inlet water to said freezing chamber;

the ice compression means for receiving the ice shavings from said freezing chamber and compressing the ice shavings into compacted solid form ice while squeezing water from the ice shavings;

the process of reducing scale buildup from the dissolved minerals in the water at the discharge end of the rotatable ice auger, comprising the steps of;

providing the inlet water to the discharge end of the freezing chamber for generating a first flow along the rotatable ice auger from the discharge end of the rotatable ice auger, generating a second flow of water squeezed from the ice shavings at the ice compression means, combining the first flow of water and the second flow of water flow at the first zone, flowing the combined first flow of water and second flow of water in an opposite direction to an ice conveyance direction generated by the rotatable ice auger from the first zone to the water reservoir of a second volume smaller than the first volume, with the water reservoir being at an opposite end of the rotatable ice auger from the discharge end of the rotatable ice auger;

conveying minerals dissolved in the water from the first zone of the first volume to the water reservoir of the second volume.

9. The process of claim 8, including an ice transport tube for receiving the compacted solid form ice from said ice compression means.

10. The process of claim 8, including the step of reducing a concentration of dissolved minerals in the water in the first zone of the first volume as the inlet water is conveyed to the water reservoir of the second volume.

11. The process of claim 8, wherein a provision of inlet water to the discharge end of the rotatable ice auger is continuous.

12. The process of claim 8, wherein a provision of inlet water to the discharge end of the rotatable ice auger is pulsed.

13. A process of producing compacted solid form ice of reduced concentration of dissolved minerals comprising the process according to claim 8.

14. A process of flushing water containing dissolved minerals in an ice making apparatus for a continuous production of ice of a nugget forming type from ice shavings that are compacted, wherein the ice making apparatus comprises:

a refrigeration system for providing refrigerant to a freezing chamber of a hollow cylinder type;

the freezing chamber having a hollow cylindrical inner wall for receiving water within the freezing chamber for forming ice on said hollow cylindrical inner wall;

a rotatable ice auger sized to fit inside said freezing chamber and comprising means for scraping ice formed on the hollow cylindrical inner wall of said freezing chamber and forming the ice shavings and conveying the ice shavings from the hollow cylindrical inner wall of said freezing chamber, along said rotatable ice auger, to an ice discharge end of the rotatable ice auger in the freezing chamber and squeezing water from the ice shavings at the discharge end of the rotatable ice auger to generate a flow squeezed of water;

means to cause rotation of said rotatable ice auger;

means for supplying inlet water to said freezing chamber at the ice discharge end of the rotatable ice auger for generating a flow of inlet water;

flowing the flow of inlet water and the flow of squeezed water from the discharge end of the rotatable ice auger to a water reservoir receiving the ice shavings in an ice compression means outside the freezing chamber from said freezing chamber and compressing the ice shavings thereby forming compacted solid ice while squeezing the water from the ice shavings;

the water reservoir located at an end of the rotatable ice auger opposite the ice discharge end of the rotatable ice auger;

the process of flushing the water containing the dissolved minerals from the ice making apparatus during the continuous production of ice including the steps:

supplying the flow of inlet water to the freezing chamber while dispensing water containing the dissolved minerals from the water reservoir, wherein the supplying and dispensing steps are any one of:

continuous; and pulsed.

15. The process of claim 14, wherein the supplying and dispensing steps are continuous.

16. The process of claim 15, including a step of monitoring a level of water in the reservoir.

17. The process of claim 14, wherein at least one of the supplying and dispensing steps are pulsed.

18. The process of claim 17, including a step of monitoring a level of water in the reservoir.

19. The process of claim 17, including a step of monitoring a level of water in the water reservoir and controlling the supplying and dispensing steps as a function of the water level in the water reservoir.

* * * * *